US005302030A

United States Patent [19]

Buie et al.

[11] Patent Number: 5,302,030

[45] Date of Patent: Apr. 12, 1994

[54] ADJUSTABLE ROLLER

[75] Inventors: Scott Buie, Statesville; Kurt P. Rindoks, Cornelius; Mike Patton, Maiden, all of N.C.

[73] Assignee: Kewaunee Scientific Corporation, Statesville, N.C.

[21] Appl. No.: 905,538

[22] Filed: Jun. 29, 1992

[51] Int. Cl.[5] ..... A47B 88/00

[52] U.S. Cl. ..... 384/18; 312/334.19; 384/57; 384/449

[58] Field of Search ..... 384/19, 22, 18, 57, 384/58; 312/341

[56] References Cited

U.S. PATENT DOCUMENTS

| | | | |
|---|---|---|---|
| 353,640 | 11/1886 | Nourse . | |
| 2,550,980 | 5/1951 | Drake | 312/348 |
| 2,752,219 | 6/1956 | Yonkers | 312/341 |
| 2,843,444 | 7/1958 | Nelson | 312/341 |
| 2,885,694 | 5/1959 | Ulm . | |
| 2,928,696 | 3/1960 | Hiers . | |
| 3,245,742 | 4/1966 | Lampman | 312/304 |
| 3,265,450 | 8/1966 | Aho . | |
| 3,418,026 | 12/1968 | Ericson | 384/19 |
| 3,469,892 | 9/1969 | Langstroth | 384/547 X |
| 3,874,748 | 4/1975 | Figueroa . | |
| 3,994,549 | 11/1976 | Davis | 312/253 |
| 4,295,688 | 10/1981 | Blasnik | 384/449 X |
| 4,595,247 | 6/1986 | Zank | 312/343 |
| 4,620,801 | 11/1986 | MacDonald | 384/19 |
| 4,834,557 | 5/1989 | Dreinhoff | 384/57 X |
| 4,863,288 | 9/1989 | Houck | 384/19 |
| 4,914,712 | 4/1990 | Ikimi et al. | 384/449 |
| 4,958,943 | 9/1990 | Nakanishi | 384/478 X |
| 4,979,262 | 12/1990 | Lautenschläger | 384/19 X |

FOREIGN PATENT DOCUMENTS

| | | |
|---|---|---|
| 2915009 | 10/1980 | Fed. Rep. of Germany . |
| 1361254 | 8/1964 | France . |

*Primary Examiner*—Thomas R. Hannon

*Attorney, Agent, or Firm*—Hill, Steadman & Simpson

[57] ABSTRACT

A roller bearing assembly for a drawer slide providing a roller wheel having a threaded bore therethrough and a stud adjustably threaded into said bore, the stud attachable at an opposite end to either an interior wall channel of a cabinet or to a drawer, and said roller wheel rollable on a bracket provided on a respective other of said interior wall of the cabinet or the drawer. The lateral position of the roller wheel with respect to the cabinet or the drawer can be adjusted by selectively progressing the threaded stud into the threaded bore. The stud can be progressed into the bore by turning a hexagonal portion of the roller wheel surrounding the bore. The stud is typically anchored to the cabinet or drawer by insertion through an aperture and by deforming an end of the stud rivet style.

19 Claims, 2 Drawing Sheets

ADJUSTABLE ROLLER

BACKGROUND OF THE INVENTION

This invention relates to a roller bearing for use in a sliding drawer assembly. Particularly, this invention relates to a laterally adjustable roller for use on drawer slides.

U.S. Pat. No. 2,843,444 to Nelson discloses drawer rollers which are mounted for lateral adjustment on a threaded stud with a lock nut threaded thereover for locking the position of the threaded stud in selected adjustment with respect to a threaded bracket. The stud provides a screw slot on one end of the threaded stud.

U.S. Pat. No. 4,595,247 to Zank discloses a drawer and cabinet roller arrangement. U.S. Pat. No. 2,752,219 to Yonkers discloses a roller which has a stud shaft to receive a nut to anchor the roller to a drawer. U.S. Pat. No. 2,928,696 to Hiers discloses a drawer tilt adjustment means which vertically adjusts a roller and once adjusted, lock nuts clamp a roller shaft in fixed position with respect to the drawer.

U.S. Pat. No. 3,874,748 to Figueroa discloses a lateral adjustment means for a roller, the roller attached to framework on lateral sides of the drawer and rolling in a C-shaped channel element secured to the drawer. The roller is held about a screw which by turning draws the roller along a length of a bushing toward or away from the framework to laterally adjust the location of the roller with respect to the C-shaped channel element.

The prior art shows that it is known to use a threaded arrangement to position a roller for a drawer laterally with respect to the framework.

It is heretofore not known to use the simple and effective arrangement of the present invention.

SUMMARY OF THE INVENTION

The present invention provides an adjustable roller for a drawer for use on drawer slides. The rollers are particularly suited for use in laboratory furniture. Four rollers are typically used for each drawer assembly. Two rollers are mounted to the drawer body while two other rollers are similarly mounted to channels or brackets located on each side of the cabinet. The rollers provide a four point mounting system for the drawer.

The adjustable roller eliminates the side-to-side play that occurs due to manufacturing tolerances and variances. The excessive play is eliminated by selectively turning the roller along a threaded stud. A hex-shaped section adjacent the roller allows a wrench to be used to rotate the roller. By adjusting the rollers, the installer can accommodate different dimensions that may be encountered due to different drawers or cabinets.

The roller is fixedly held to a bracket or channel on either the framework or the drawer. One method of attachment is to insert the stud through an aperture of a metal bracket or channel having an irregular perimeter such as a multi-point star shape. The lead end of the stud is then deformed or "mashed" (like a rivet), creating a rivet head and preventing retraction from the aperture. The deformation also causes an expansion of the stud diameter and a tight gripping by the aperture preventing rotation of the stud. Thereafter, the hex-shaped section can be rotated independently of the stud.

The present disclosure can provide advantages over the prior art such as U.S. Pat. No. 3,874,748, in that it is a simpler device which does not need a spring or a bushing which must be machined to be slidable axially but not rotatably through the inner race of the roller. Additionally, the rollers can conceivably be adjusted with the drawer in place. The screw mechanism of the prior art patent 3,874,748 to Figueroa cannot be easily turned when covered by the drawer.

DETAILED DESCRIPTION OF THE PREFERRED EMBODIMENTS

Figure 1:
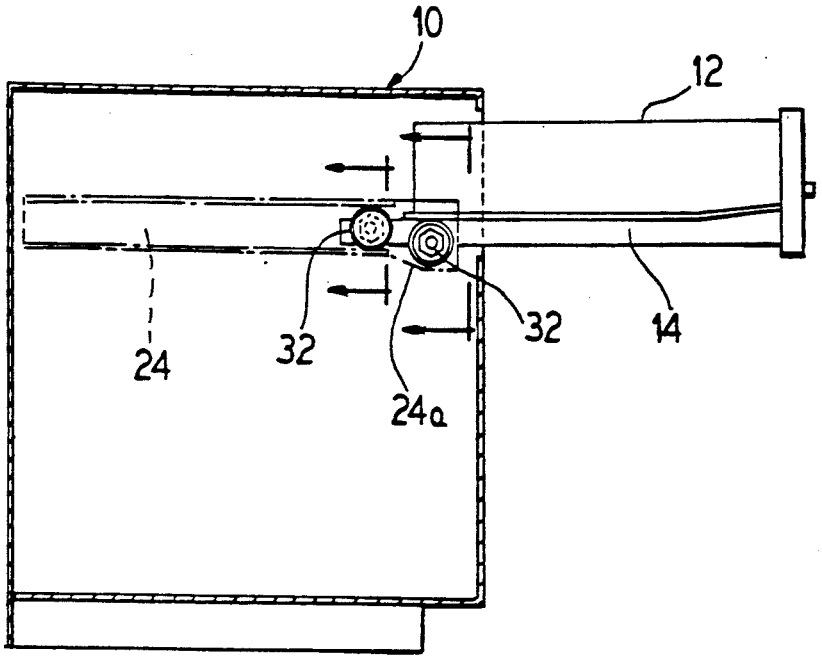
FIG. 1 is a side elevational view of a drawer and framework of the present invention with a side wall removed for clarity.
Figure 8:
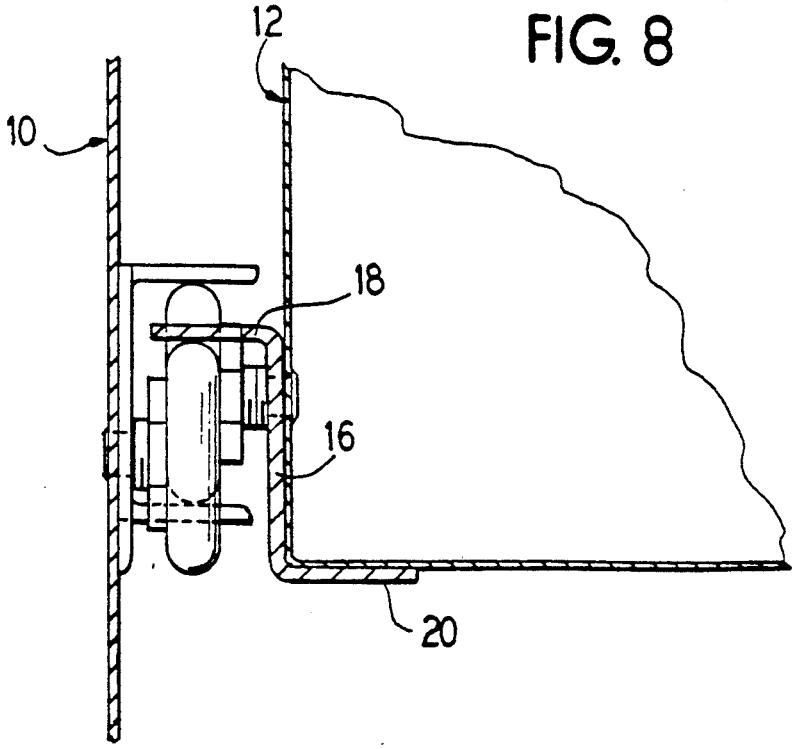
FIG. 8 is a partial sectional view of the drawer and framework taken generally along line VIII—VIII of FIG. 1.

FIG. 1 shows a framework such as a cabinet generally defined at 10 holding suspended therein a drawer 12. The drawer 12 has drawer brackets 14 mounted on opposite lateral sides, each having a vertical portion 16 connecting an outwardly directed leg 18 and an inwardly directed leg 20 (see FIG. 8). Mounted to the cabinet 10 and facing the drawer 12 are cabinet brackets 24. The brackets 24 can be channels running the depth of the drawer.

Mounted at a back end of each drawer bracket 14 is an adjustable roller assembly 32. Mounted at a front end of each bracket 24 is a further adjustable roller assembly 32.

Figure 2:
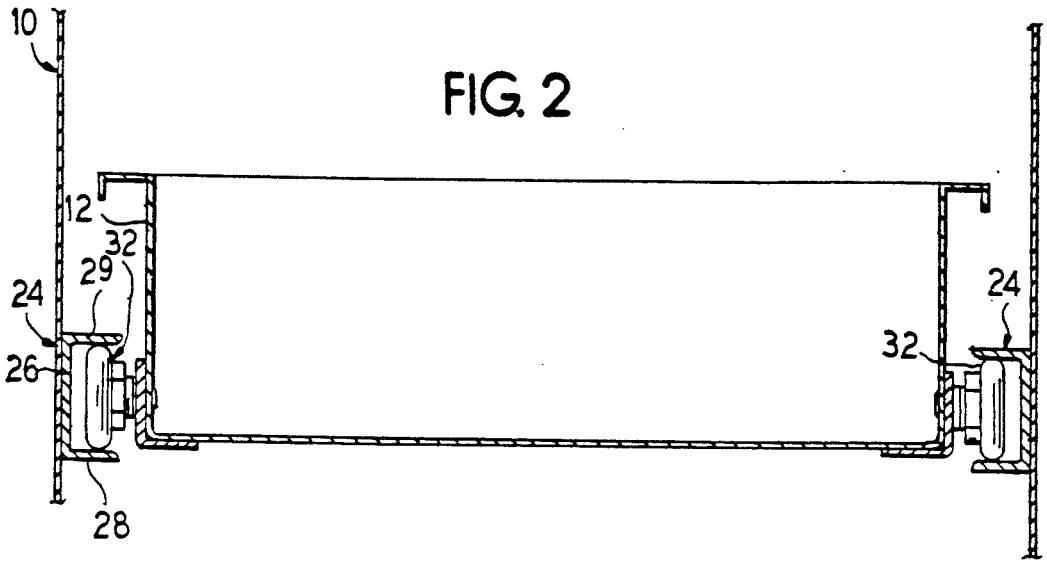
FIG. 2 is a sectional view of the drawer and framework of the present invention taken generally along line II—II of FIG. 1.

FIG. 2 illustrates the cabinet bracket 24 is C-shaped throughout most of its length except for a flat front portion 24*a* which holds the roller assemblies 32. The C-shape is formed from a vertical portion 26, a lower leg 28, and an upper leg 29. The roller assemblies 32 which are mounted to the drawer bracket 14 roll on the lower leg 28 when the drawer is half-way closed to closed and rolls on the upper leg 29 when the drawer is half-way open to open. The roller assemblies 32 which are mounted to the cabinet bracket 24 roll on the outwardly directed leg 18 of the drawer bracket 14.

Figure 3:
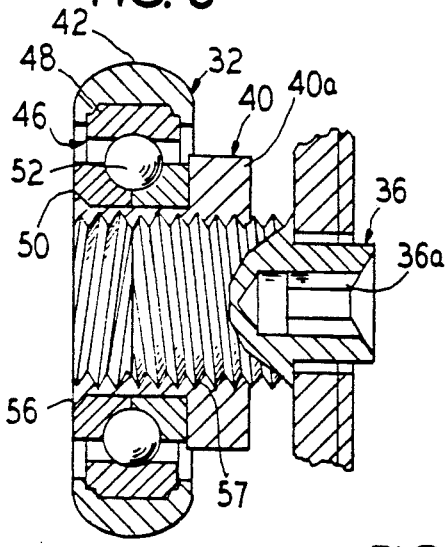
FIG. 3 is a sectional view of a roller taken generally along line III—III of FIG. 2.

FIG. 3 shows the adjustable roller assembly 32 in more detail. A stud 36 screws into an inner race 40 which can be steel. A roller outer race 42, advantageously comprising nylon, is mounted around a ball bearing assembly 46 which comprises an outer bearing race 48 surrounding an inner bearing race 50 holding a plurality of ball bearings 52 therebetween around a circumference of the inner bearing race 50. The inner bearing race 50 is held to the inner race 40 by a circumferential lip 56 formed on a front end of the inner race 40. The inner race 40 has a hexagonal outside perimeter portion 40*a*. The stud 36 has at a rear end thereof a hexagonal bore 36*a* for insertion of an allen wrench, especially useful for preassembly of the roller to the stud.

A threading compound 57 is applied between the inner race 40 and the threads of the stud 36 to prevent "self-adjusting" of the stud 36 in the race 40 by vibration or friction during use. The compound is a liquid that is applied to the stud 36 prior to assembly and allowed to cure after assembly. The compound allows the stud to be adjusted repeatedly with a wrench, yet secures the stud in the race tight enough to prevent relative movement therebetween due to vibration or other unanticipated forces. The commercial compound presently preferred is ND Anacure 2015 nut lock manufactured by ND Industries 1893 Barret Road, Troy, Mich. 48084, although other nut lock compounds may be equally acceptable.

Figure 4:
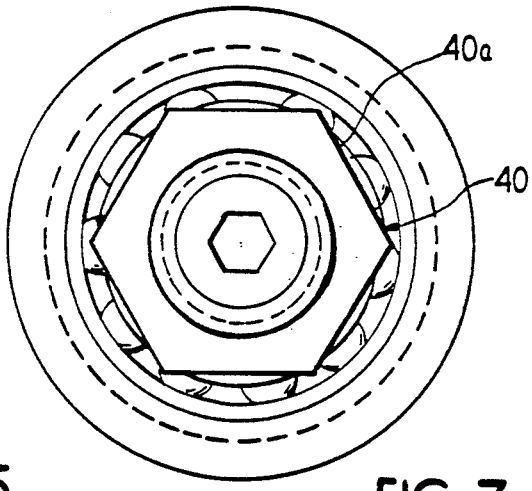
FIG. 4 is a right side elevational view of the roller of FIG. 3.
Figure 5:
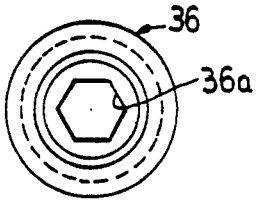
FIG. 5 is a right side elevational view of the stud of FIG. 3.

FIG. 4 shows the hexagonal perimeter portion 40*a* of the inner race 40. FIG. 5 shows the hexagonal bore 36*a* of the stud 36.

Figure 6:
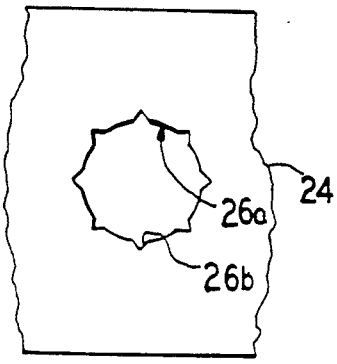
FIG. 6 is a partial elevational view of a bracket which receives the roller.

FIG. 6 shows in partial elevational view a portion of the bracket 24 having the aperture 26*a* piercing therethrough. The aperture 26*a* is generally round but has notches 26*b* formed around the perimeter.

Figure 7:
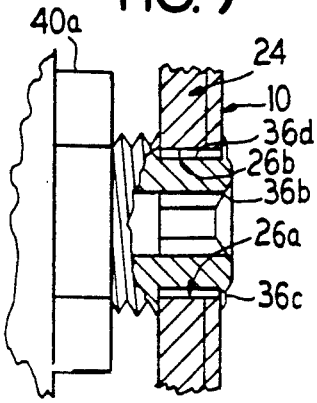
FIG. 7 is a partial sectional view of the roller and framework of FIG. 3 in final assembly.

FIG. 7 shows an inventive means of installing the roller 32 to the bracket 24. Once the stud 36 is inserted through the aperture 26*a*, a lead end 36*b* is deformed or mashed in rivet fashion. An axially retaining head or rivet head 36*c* is thus formed. Additionally, the operation deforms a perimeter 36*d* of the stud 36 to at least partially engage the notches 26*b* which prevents rotation of the stud 36 within the aperture 26*a*. It is noted that other shapes could be used for the aperture 26*b* which provide at least one flat surface or at least one nook which departs from a purely circular aperture for preventing rotation of the stud therein.

Other means of installing the stud 36 to the bracket 24 are encompassed by the present invention including: threading the stud through the bracket aperture 26*a*, providing a press fit between the aperture 26*a* and the stud 36, or simply providing the rivet head 36*c* without preventing axial rotation within the aperture 26*a*. In the latter case, the stud 36 can be prevented from axial rotation by inserting an allen wrench into the aperture 36*a*.

Additionally, the stud 36 need not be inserted through both the cabinet bracket 24 or the drawer bracket 14 and the cabinet wall 10 or drawer 12. The stud 36 could be secured first to the respective bracket 14/24 and then the respective bracket 14/24 mounted to the respective drawer/cabinet. Alternatively, if the drawer 12 or cabinet 10 had sufficient thickness, the stud could be mounted directly through the cabinet or drawer respectively and not through a bracket.

Although the present invention has been described with reference to a specific embodiment, those of skill in the art will recognize that changes may be made thereto without departing from the scope and spirit of the invention as set forth in the appended claims.

I claim as my invention:

1. An adjustable roller for a drawer held in a cabinet comprising:

an annular roller wheel support providing an axial threaded bore therethrough and having on an outside circumference thereof a radial flat side for engagement with a tool;

a roller wheel mounted around said threaded bore and journalled on said roller wheel support and having an outside surface axially rotatable with respect thereto; and a threaded stud engageable with the threaded bore and mountable to one of said drawer and said cabinet, said roller wheel rollable along a horizontal surface provided between said cabinet and said drawer, the horizontal surface mounted onto the respective other of said cabinet and said drawer, said roller wheel axially adjustable by progression or retraction of said stud into said threaded bore.

2. The roller assembly according to claim 1, wherein said stud is riveted into a C-shaped bracket provided on an interior wall of said cabinet and said drawer provides a bracket having a horizontal surface disposed thereon above said roller wheel, said drawer supported on top of said roller wheel.

3. The roller assembly according to claim 1, wherein said roller wheel comprises a ball bearing and an outer roller portion, said ball bearing comprising an inner bearing race surrounding said roller wheel support, a plurality of balls disposed around a circumference of said inner bearing race, and an outer bearing race surrounding said balls, said outer roller portion mounted around said outer bearing race said outer roller portion arranged to roll on said horizontal surface.

4. The roller assembly according to claim 1, wherein said stud provides at a lead end thereof a receptacle for receiving a tool to axially rotate said stud.

5. The roller assembly according to claim 4, wherein said receptacle comprises a hexagonal receptacle for an allen wrench.

6. The roller assembly according to claim 1, wherein said inner race provides opposing flat surfaces for engagement with a wrench around a circumference of said inner race.

7. The roller assembly according to claim 1, wherein said stud provides a lead end thereof insertable into an aperture of said one of said drawer and said cabinet and adapted to be deformed in rivet fashion.

8. The drawer slide according to claim 1, wherein a layer of thread compound is arranged between said inner race and said threaded stud.

9. The roller assembly according to claim 1 wherein said roller wheel support comprises a bearing race region and an adjustment collar adjacent thereto, said bearing race region having a smaller outside dimension than said adjustment collar, said radial flat side applied on an outside perimeter of said adjustment collar, and said bearing race region having a retaining formation on an opposite axial end thereof, said roller wheel held axially on said bearing race region between said formation and said adjustment collar.

10. A drawer slide assembly mounted between a drawer and framework holding the drawer, comprising:

a bracket mounted to one of said framework and said drawer between said framework and said drawer;

a roller assembly having a threaded stud, said threaded stud mounted to said bracket and fixed for axial and lateral movement to said bracket, said roller assembly providing an inner race having a threaded bore therethrough and having on an outside circumference thereof a flat radial side for engagement with a tool to instigate rotation of said inner race, a roller wheel mounted around said inner race and said threaded bore and axially rotatable at an outside surface with respect thereto, and said threaded stud progressible into the threaded bore of said inner race at a first end and mounted to said bracket at a second end, said roller wheel rollable along a horizontal surface provided between said cabinet and said drawer, the surface mounted onto the respective other of said cabinet and said drawer, and axial position of said roller wheel adjustable by progression or retraction of said stud into said threaded bore.

11. The drawer slide according to claim 10, wherein said bracket provides an aperture therethrough and said second end of said stud inserts through said aperture and comprises a rivet head portion on a side of said aperture opposite said roller wheel to prevent axial separation of said stud from said bracket.

12. The drawer slide according to claim 11, wherein said aperture provides at least one irregularity around its circumference departing from a circular circumference, and said stud is adapted to be deformed at least partially into said irregularity.

13. The roller assembly according to claim 10 wherein said inner race comprises a bearing race region and an adjustment collar adjacent thereto, said bearing race region having a smaller outside dimension than said adjustment collar, said radial flat side applied on an outside perimeter of said adjustment collar, and said bearing race region having a retaining formation on an opposite end thereof, said roller wheel held axially on said bearing race region between said formation and said adjustment collar.

14. A drawer slide arrangement for a drawer mounted to a cabinet comprising:

a drawer having first channels mounted on opposite lateral sides thereof, the first channels providing outwardly disposed first horizontal legs;

second channels arranged outside said opposite lateral sides of said drawer mounted to said cabinet in facing relation to said first channels, said second channels providing inwardly directed second horizontal legs spaced below said outwardly directed first horizontal legs;

four roller assemblies, a first and a second roller assembly mounted to said second channels and directed inwardly toward said first channels and each located vertically between a respective first horizontal leg and a respective second horizontal leg, a third and a fourth roller assembly mounted one to each of said first channels and directed toward said second channels, each located vertically between a respective first horizontal leg and a respective second horizontal leg;

each said roller assembly comprising an inner race having a threaded bore therethrough and having on an outside circumference thereof a flat side for engagement with a tool, a roller wheel mounted around said inner race and said threaded bore, and axially rotatable at an outside surface with respect thereto, and a threaded stud engageable with a threaded bore of said inner race and mountable at an opposite end thereof to one of said first channel or said second channel;

said roller wheels of said first and second roller assemblies supporting said first horizontal legs and rollable therealong; and said roller wheels of said third and fourth roller assemblies supported on said second horizontal legs and rollable therealong.

15. The drawer slide assembly according to claim 14, wherein said first and second channels provide apertures therethrough for receiving said opposite ends of said studs for mounting, and said studs providing means for preventing axial and rotational movement between said stud and the respective first or second channel attached thereto.

16. The drawer slide assembly according to claim 15, wherein said studs are fashioned to have a rivet head to overlie a backside of said aperture after said stud has been inserted therethrough to prevent axial removal of said stud from said respective first or second channel.

17. The drawer slide assembly according to claim 16, wherein said apertures provide notches around their circumference and said studs provide deformities which interengage with said notches to prevent axial rotation of said studs installed thereinto.

18. The drawer slide assembly according to claim 14, wherein said inner race provides a hexagonal outside circumference located between said roller wheel and said respective first or second channel for engagement with a wrench to progress said stud through said inner race.

19. The roller assembly according to claim 14 wherein said inner race comprises a bearing race region and an adjustment collar adjacent thereto, said bearing race region having a smaller outside dimension than said adjustment collar, said radial flat side applied on an outside perimeter of said adjustment collar, and said bearing race region having a retaining formation on an opposite end thereof, said roller wheel held axially on said bearing race region between said formation and said adjustment collar.

* * * * *